US005275338A

United States Patent [19]

Tobler

[11] Patent Number: 5,275,338

[45] Date of Patent: Jan. 4, 1994

[54] DEVICE FOR SPRAYING OR ATOMIZING A LIQUID

[75] Inventor: Viktor Tobler, Oberdürnten, Switzerland

[73] Assignee: Supermatic Kunststoff AG, Uster, Switzerland

[21] Appl. No.: 870,833

[22] Filed: Apr. 20, 1992

[30] Foreign Application Priority Data

Apr. 23, 1991 [CH] Switzerland ..... 01214/91-6

[51] Int. Cl.[5] ..... B05B 11/04

[52] U.S. Cl. ..... 239/327; 239/372; 239/490; 222/211; 222/212; 222/519

[58] Field of Search ..... 239/327, 343, 372, 369, 239/487-; 222/211, 190, 212, 519-

[56] References Cited

U.S. PATENT DOCUMENTS

| | | | |
|---|---|---|---|
| 2,980,342 | 4/1961 | Armour | 222/211 |
| 3,794,247 | 2/1974 | Corsette | 239/327 |
| 3,963,150 | 6/1976 | Steiman et al. | 222/211 |
| 4,122,979 | 10/1978 | Laauwe | 222/211 |
| 4,157,789 | 6/1979 | Laauwe | 222/211 |
| 4,162,749 | 7/1979 | Bennett | 222/212 |
| 5,048,750 | 9/1991 | Tobler | 239/327 |
| 5,156,307 | 10/1992 | Callahan et al. | 239/327 |

FOREIGN PATENT DOCUMENTS

| | | |
|---|---|---|
| 0217744 | 4/1987 | European Pat. Off. . |
| 82238367 | 11/1982 | Fed. Rep. of Germany . |

*Primary Examiner*—Karen B. Merritt

*Attorney, Agent, or Firm*—Oblon, Spivak, McClelland, Maier & Neustadt

[57] ABSTRACT

A device is used for spraying and atomizing a liquid which is held in a container which can be emptied by air pressure. If in a device of this kind a liquid nozzle projects into a mixture nozzle disposed coaxially in front of it, so that an annular space provided for air around the liquid nozzle is open at the front towards the mixture nozzle, the feed paths for liquid and for air must not be transposed. Such transposition occurs if the container is held upside-down during spraying. In order to avoid this disadvantage two annular spaces are provided, from which passages lead to a mixture nozzle. The two annular spaces communicate with one another via throttle slots. Because of the two annular spaces the liquid can also be sprayed when the container is upside-down.

12 Claims, 3 Drawing Sheets

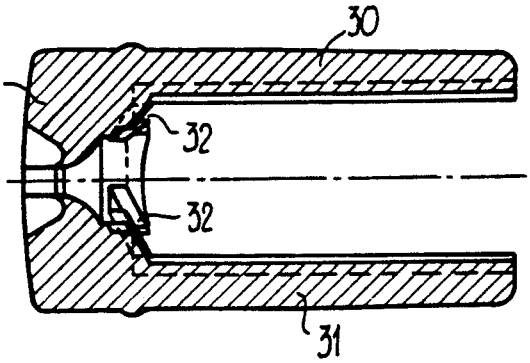
Fig.9
Fig.8
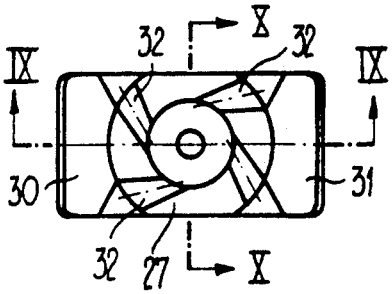
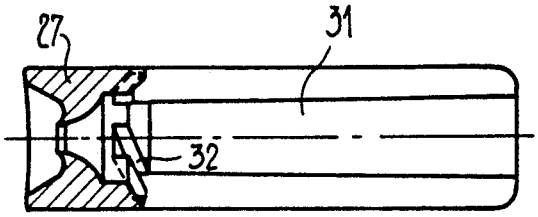
Fig.10
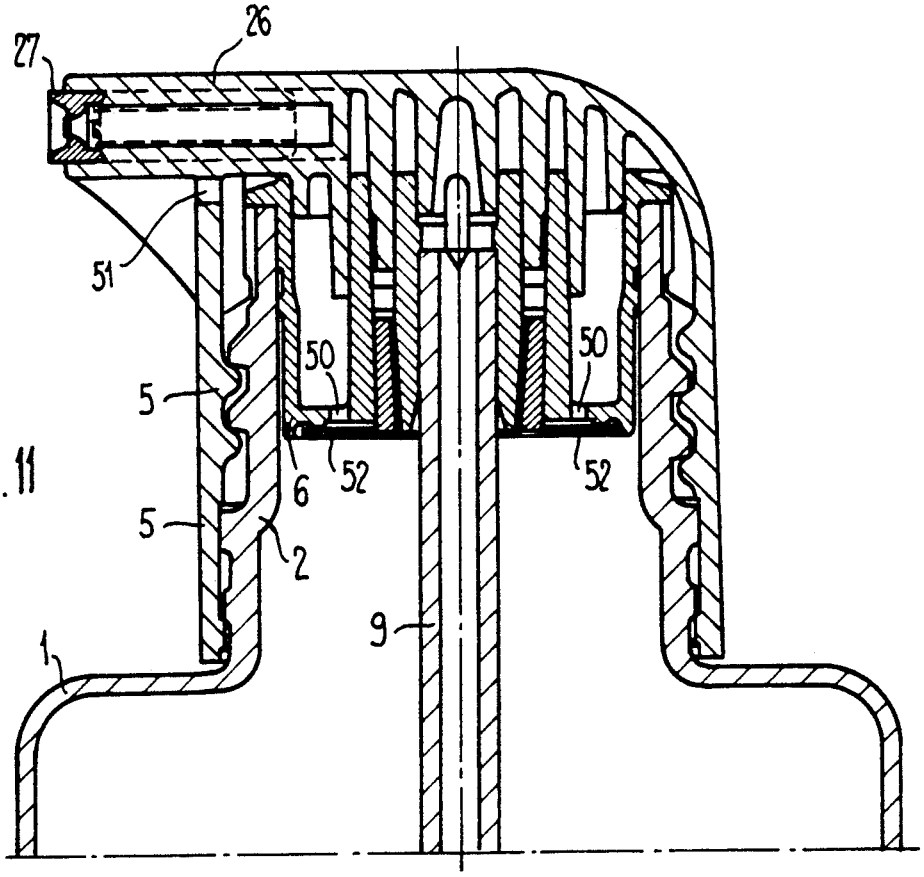
Fig.11

DEVICE FOR SPRAYING OR ATOMIZING A LIQUID

BACKGROUND OF THE INVENTION

1. Field of the Invention

The invention relates to a device for spraying or atomizing a liquid held in a container which can be emptied by pressure and which has a closure part in which feed cavities are formed for the liquid fed through a feed tube extending from the closure part into the interior of the container and for the air present in the container above the liquid, the feed cavities leading to a mixture nozzle formed for the liquid/air mixture on the closure part of the container.

2. Discussion of the Related Art

A spray device of this kind, which can be mounted on a compressible container is known from EP-A-217744, in which a liquid nozzle projects into a mixture nozzle disposed coaxially in front of it, so that an annular space provided for air around the liquid nozzle is open at the front towards the mixture nozzle. With this arrangement of the feed cavities in this device it is intended to ensure that a substantial part of the kinetic energy contained in the faster air current is transmitted to the liquid. The liquid passing out of the liquid nozzle lying to the rear is entrained, somewhat according to the principle of a jet pump, by the substantially faster air current, for which purpose the outlet speed at the mixture nozzle should be twenty times as high as the outlet speed at the liquid nozzle. This means that in this device the feed paths for liquid and for air cannot be transposed. This transposition would occur if it were desired to work with the known spray device and container used upside-down, because the liquid present in the container then passes into the spray device over the path otherwise provided for the compressed air present in the container above the liquid, while in addition the compressed air would be fed through the feed tube. With the known device, a liquid therefore cannot be sprayed with the container held upside-down.

SUMMARY OF THE INVENTION

The problem underlying the present invention was therefore that of providing a device for spraying or atomizing a liquid held in a compressible container, which device can also be used upside-down and which can be produced inexpensively from parts known in the plastics industry for containers of a similar kind.

Accordingly, the present invention provides for a device for spraying or atomizing a liquid held in a container which can be emptied by pressure. The device comprising a container having a feed tube disposed therein, and a closure part positioned on the container. The feed tube extending from the container to the closure part with the closure part comprising feed cavities for liquid from the container fed through the feed tube and air present in the container above the liquid. The feed cavities lead to a mixture nozzle formed for liquid/air mixture on the closure part. The closure part including an insert disposed in a container neck of the container and a cap adapted to be screwed onto the container neck of the container and be moved in an axial direction by turning the cap between a closed position and an open position. The feed cavities comprising annular spaces disposed in the cap and the insert for the transposable delivery of liquid and air. The annular spaces being defined between annular walls which are provided on the insert and the cap and being concentric to one another.

The device has the advantage that with it a liquid can be sprayed, without an external supply of pressure medium, in any position and in particular in the upside-down position, for example when otherwise the place of use is inaccessible. In this working position the device must not drip, as would be the case with other known devices of this kind, because in the latter the cross-sections of the delivery paths for air and for liquid are designed for normal use with the container in the upright position. If, however, during operation in the upside-down position the liquid no longer passes to the nozzle through the usual feed tube, but all the liquid held in the container lies, under the existing pressure, above the passage otherwise used for delivering air to the nozzle, special arrangements are necessary for reducing the pressure.

BRIEF DISCUSSION OF THE DRAWINGS

Further details and advantages of the invention can be seen from the following description and from the drawings, in which one embodiment of the invention is illustrated solely by way of example, and in which:

FIG. 8 is a view of the rear side of the mixture nozzle body inserted at the nozzle end;

FIGS. 9 and 10 show axial sections through the mixture nozzle body, taken on the lines 8—8 and 9—9 in FIG. 8; and FIG. 11 is a vertical section through the top part of a container of a modified embodiment.

DESCRIPTION OF THE PREFERRED EMBODIMENTS

Figure 1:
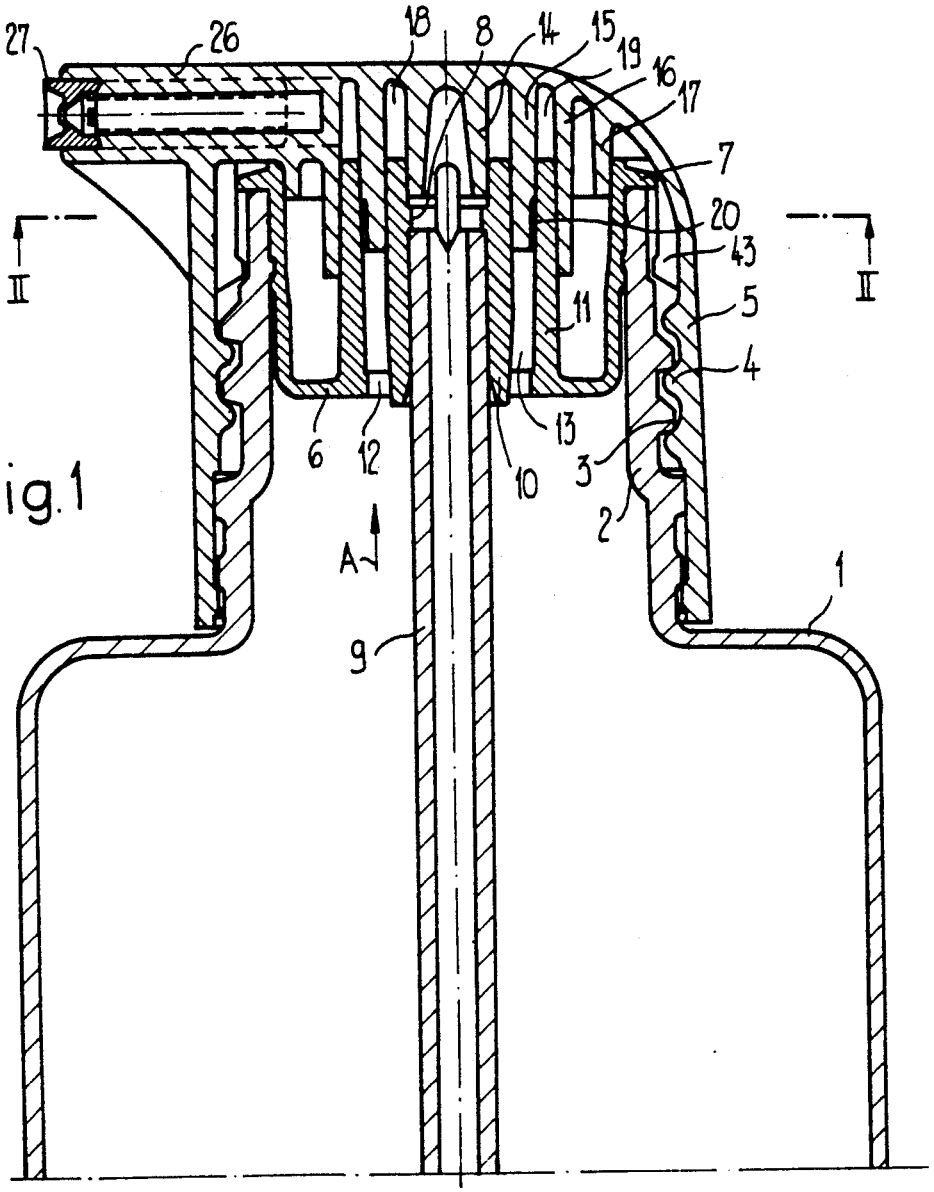
FIG. 1 is a vertical section through the top part of the container together with the spray device.
Figure 4:
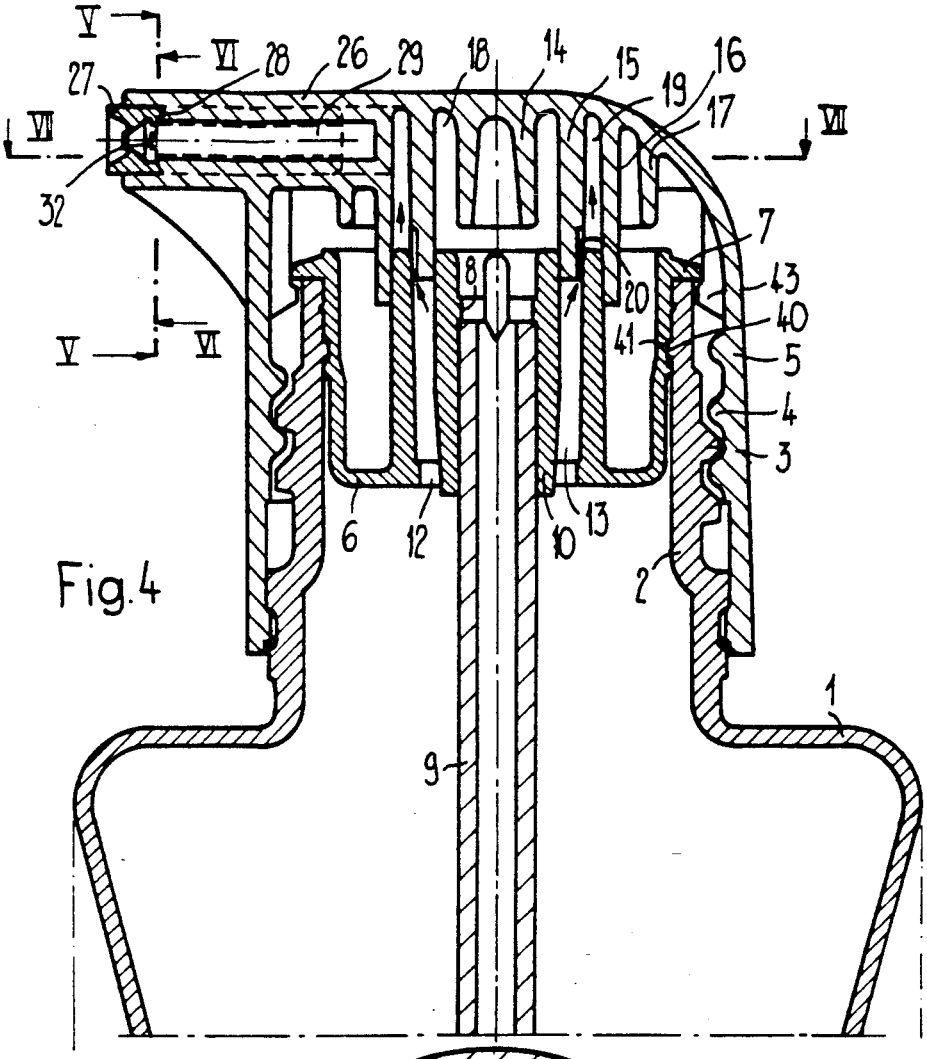
FIG. 4 is a vertical section through the top part of the container together with the spray device, in the open state.

The device comprises a container 1, which is made of resilient, compressible material and of which only the top part is shown in FIGS. 1 and 4. A cap 5 provided with an internal screw thread 4 is screwed onto the container neck 2, which has an external screw thread 3. The cap 5 can be adjusted by a screwing movement from a closed position, shown in FIG. 1, to an open position, shown in FIG. 4. An insert 6 is fitted in the container neck 2 and lies with a top flange edge 7 on the top edge of the container neck. The insert disposed in the container neck 2 and sealed at the outer periphery has a central through bore 8 into which the feed tube 9 extends from below. In addition, the insert 6 has two annular walls 10 and 11 which are concentric to one another, and of which the inner wall at the same time delimits the central bore 8. Four gaps 12 tapering in wedge shape lead from outside into the space between the annular walls 10 and 11. The gaps 12 permit pressure regulation. Between the two annular walls 10 and 11 an annular space 13 is present, through which the air present in the container above the liquid flows when the cap is open, which in the closed position shown in FIG. 1 is not possible because the inner space is closed from above. On the inside the cap 5 has a plurality of annular walls 14, 15, 16 and 17 which are concentric to one another and, in relation to the annular walls 10 and 11 formed on the insert 6, are disposed radially offset in such a manner that the annular walls of the cap and the annular walls of the insert extend telescopically into one another. The annular space 13 for the air is therefore closed by the annular wall 15 extending into this space. The annular walls 14 and 15 of the cap 5 delimit between them an annular space 18 which in the open position, when, as shown in FIG. 4, the cap 5 is screwed upwards, is in communication with the central bore 8 into which the feed tube 9 extends, so that, when the container 1 is used in the upright position for spraying, the liquid passes into the annular space 18 in the cap 5.

Figure 2:
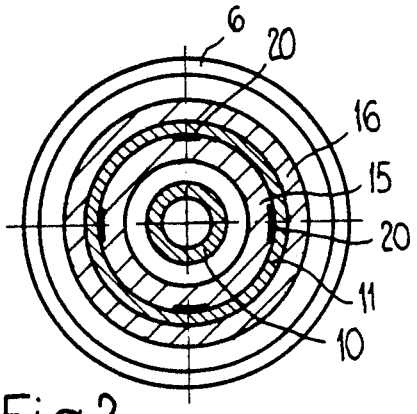
FIG. 2 is a cross-section through a part of the spray device, taken on the line 2—2 in FIG. 1.
Figure 3:
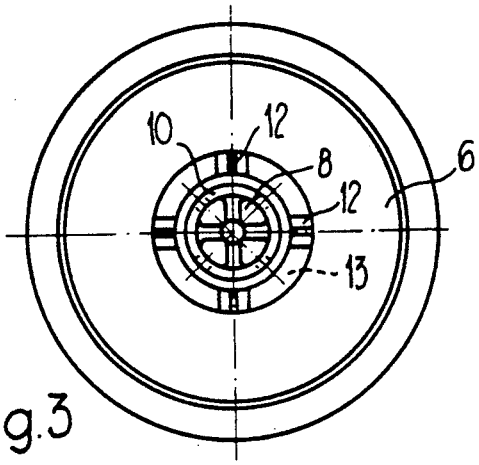
FIG. 3 is a view of the underside of the insert disposed in the container, viewed in the direction of the arrow A in FIG. 1.

The annular walls 15 and 16 of the cap 5 delimit the annular space 19 which lies between them and into which the annular wall 11 of the insert 6 extends. From FIG. 4 it can be seen that, when the device is in the open position, the previously mentioned annular space 13 in the insert is in communication with the annular space 19 in the cap, these annular spaces being only in throttled communication, even in the open position, because the annular cap wall 15, which even in the open position still extends slightly into the annular space 13, is provided on the outside with throttle slots 20 which extend in the axial direction over an end portion, and of which according to FIG. 2 four are distributed over the periphery. When the container is used upright these throttle slots 20 always allow the passage of sufficient air under pressure which is required at the nozzle for spraying, but if the container has to be held upside-down for spraying they serve as a throttle aperture or baffle for the liquid then flowing directly from the container 1 through the annular space 13 into the annular space 19 in the cap. In comparison with the normal path of the liquid through the feed tube 9, in the case of use upside-down a higher liquid pressure corresponding to the much larger cross-sectional area of the container comes into action and is reduced by the throttle slots 20 and the gaps 12 on the insert at the bottom, in order to achieve once again a correct pressure ratio suitable for spraying.

The continuation of the feed cavities from the separate annular spaces 18 and 19 in the cap 5 consists of separate passages 22, 23, 24 and 25, extending transversely to the container axis inside the cap, inside an extension 26 which is formed on the side of the cap 5 and through which the four separate passages lead to a mixture nozzle 27 disposed at the end of the extension.

Figure 7:
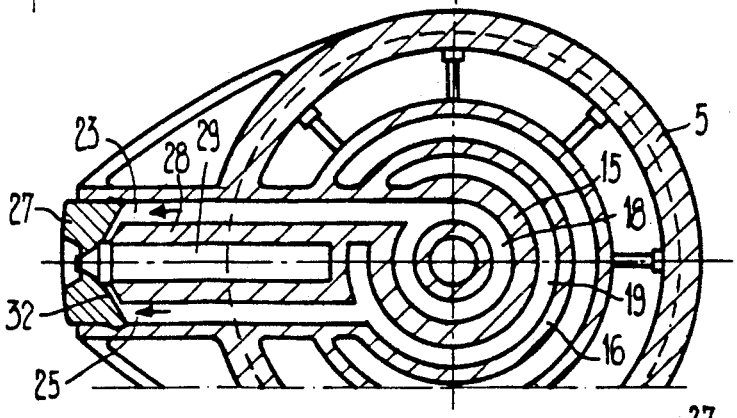
FIG. 7 is a cross-section through the cap, taken on the line 7—7 in FIG. 4.
Figure 5:
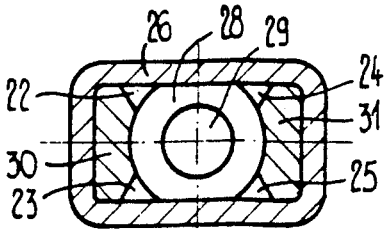
FIG. 5 is a cross-section through the nozzle end of the device, taken on the line 5—5 in FIG. 4.
Figure 6:
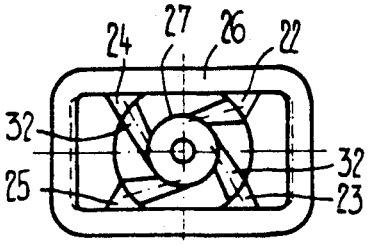
FIG. 6 is a cross-section through the nozzle end of the device, taken on the line 6—6 in FIG. 4.

As can be seen in FIGS. 5, 6, and 7, the extension 26, which is in the form of a hollow body and externally has a substantially rectangular cross-section, has an annular inner wall 28 provided with a central blind bore 29, and two filling members 30 and 31 are inserted, between the inner wall 28 and the outer wall of the extension 26, on opposite sides into the gaps present there. Together with the inner wall 28 and the outer wall 26 of the extension, each of the filling members delimits two passages 22, 23 and 24, 25 respectively, the passages 22 and 23 being in communication with the annular space 18, and the passages 24 and 25 being in communication with the annular space 19 in the cap. All four passages are slightly narrowed towards the front end and are in communication with slots 32 which at the front end of the inner wall 28 lead, at right angles to the passages and preferably tangentially, into the cavity of the mixture nozzle 27. The four passages 22 to 25 and the slots 32, including the mixture nozzle 27, may be of different construction in their inside cross-section, this depending on the contents of the container in each individual case. The tangential entry produces swirling and good mixing of air and liquid. The mixture nozzle 27 is preferably made in one piece with the two filling members 30 and 31 and forms the web between two flanges in the form of the filling members. The slots 32 are formed on the underside in the mixture nozzle 27, as can be seen in FIGS. 9 and 10. The blind bore 29, which is present for manufacturing reasons, contains an air cushion which is located behind the mixture nozzle 27 and which has been found very advantageous for the homogenization of the spray delivery. The extension 26 formed on the cap 5 and equipped with the mixture nozzle 27 can also be directed upwards in the axial direction.

Another embodiment, shown in FIG. 11, likewise comprises a container 1 provided with a cap 5 screwed onto the neck 2 of the container. As in the embodiment shown in FIGS. 1 and 4, the container neck 2 contains an insert 6, which in the same way as in the previously described embodiment cooperates with the cap 5 in order to open and close flow paths formed in the insert 6 and in the cap 5 for the medium which is to be delivered and for air.

For special applications, such as for example for the delivery of foam from a foamable liquid held in the container and forming foam at the nozzle with the aid of the air passing into it, it is advantageous to provide a separate air path for the return air. The insert 6 is therefore also provided in its bottom surface with through holes 50, and the cap 5 is provided with a through hole 51 under the extension 26 equipped with the mixture nozzle. Through these two through holes 50 and 51 return air can pass into the container 1 when the cap 5 is open. This return air path must however be closed when the container 1 is compressed in order to deliver the liquid held in the container or the foam. The through holes 50 in the insert 6 can thus be closed by a diaphragm-like valve 52 when no return air is being sucked into the container. If for example foam is produced from a foamable liquid in the container and is delivered, and if the container has only the air path provided in the embodiment shown in FIG. 1 for the passage of the return air through the mixture nozzle, the foam will be sucked back into the container through the flow path inside the cap and the insert, so that the volume of air inside the container will be reduced. The larger flow path in the embodiment shown in FIG. 11 not only prevents this, but also permits faster pumping because of the amount of air made available again more quickly in the container. Even with a relatively small cross-section of the mixture nozzle 27, through holes 50 and 51 are provided for the return air in order to achieve the advantages mentioned above.

In other respects the construction of the flow paths in the insert 6 and in the cap 5 is the same as in the embodiment shown in FIGS. 1 and 4, which means that with a container as shown in FIG. 11 foam can also be delivered using the container upside-down.

As can be seen in FIG. 4, the otherwise cylindrical inside of the container neck 2 is provided with a bead 40 projecting radially inwards, and the outer side of the insert 6 is provided with a groove 41 which cooperates with the bead 40 and in which the latter engages, so that this bead and groove connection 40, 41 forms a locking means preventing the insert 6 from being pulled out in the axial direction. This locking means nevertheless has only a limited action and, depending on the dimensions selected for the bead 40, can be overcome if the insert 6 is intended for a container 1 designed to be refillable, for which purpose the insert 6 has to be removed from the container neck 2. The locking means cannot, however, be overcome when a bead 40 of larger radial dimensions is provided in a container not intended to be refillable. The difference in the dimensions of the bead 40 is not very great; for example, in a refillable container the bead 40 projects 0.2 millimeters beyond the cylindrical inside of the container neck in the inward direction, and in a non-refillable container it projects 0.4 millimeters beyond the inside. In other words, the bead 40 is selectively given diameters of different sizes for two different types of containers 1, one of which is refillable and the other is not refillable.

For the extraction of the insert 6 in the case of a container intended to be refilled, a boss 43 projecting radially inwards in the direction of the container neck 2 is formed on the inside of the screw cap 5. This so-called refill boss 43 engages behind the projecting end flange 7 on the insert 6, so that during the screwing movement of the cap 5 in the opening direction, the insert 6 is simultaneously moved in the axial direction, the locking means consisting of the bead 40 and the groove 41 being overcome because the plastics material used for all the parts is able to yield resiliently, although this locking means can be overcome only when the bead 40 is of smaller size. The boss 43 on the cap 5 is designed to tear of fwhen a bead 40 of larger size is provided, so that the locking means formed by the bead 40 and the groove 41 cannot be overcome and the insert 6 thus remains in the container neck 2. The container therefore cannot be refilled and is made unusable, as intended by the manufacturer.

In an embodiment which is simple to manufacture, the cap of a container not intended to be refillable is not provided with a boss on the inside. All containers have a bead and groove connection 40, 41 of the same dimensions, that is to say without any difference in the radial dimensions of the groove 41 and bead 40, and only containers intended for re-use are provided with a cap 5 having a boss 43 for the extraction of the insert 6 from the container neck 2.

I claim:

1. A device for spraying or atomizing a liquid held in a container which can be emptied by pressure, the device comprising:

a container having a feed tube disposed therein; and a closure part positioned on the container, said feed tube extending from said container to the closure part, said closure part comprising feed cavities for liquid from the container fed through the feed tube and air present in the container above the liquid, said feed cavities leading to a mixture nozzle formed for liquid/air mixture on the closure part;

said closure part comprising:

an insert disposed in a container neck of the container, said insert having a central bore through which the feed tube coaxially extends; and a cap adapted to be screwed onto the container neck of the container and to be moved in an axial direction by turning the cap between a closed position and an open position, said mixture nozzle being positioned on said cap;

said feed cavities comprising:

annular spaced disposed in said cap and said insert for the transposable delivery of liquid and air, said annular spaced being defined between annular walls which are provided on said insert and said cap and are concentric to one another, the annular walls on said insert being radially offset form the annular walls on the cap so as to permit the annular walls on the cap to telescopically extend into the annular spaces defined by the annular walls on the insert, and permit the annular walls on the insert to telescopically extend into the spaces defined by the annular walls on the cap;

wherein:

said annular spaces include a first annular space in said cap and a second annular space in said insert which communicate with each other via a throttle means when the cap is in the open position; and a plurality of passages are formed inside said cap, said plurality of passages extending separately from the annular spaces in the cap for leading liquid and air to said mixture nozzle, said plurality of passages leading substantially tangentially into said mixture nozzle.

2. The device according to claim 1, wherein the second annular space in the insert is concentric to said feed tube and in communication with the interior of the container by way of a plurality of throttle gaps, one of said annular walls on said cap which extends into said second annular space comprising said throttle means in the form of throttle slots, said throttle slots extending in an axial direction along an end portion of said one annular wall on said cap for opening and closing one of said first and second annular spaces upon the actuation of the cap;

said throttle slots forming a portion of an air path when the container is used in an upright manner, and when the container is used in an upside-down manner, the throttle slots form cross-sectional constrictions having a throttle action for liquid which passes through the second and first annular spaces in the insert and cap.

3. The device according to claim 1, wherein the cap comprises an extension, said plurality of passages being formed in said extension, a first passage and a second passage of said plurality of passages being in communication with said first annular space in the cap and a third passage and a fourth passage of said plurality of passages being in communication with a further annular space of said annular spaces in said cap which is positioned radially inwardly of said first annular space.

4. The device according to claim 3, wherein: said extension comprises an outer wall and is in the form of a hollow body having a substantially rectangular external cross section, the extension also comprising an inner wall having a central blind bore with gaps being formed between said outer and inner walls of the extension, such that first and second filling members are inserted in the gaps;

the first and second filling members and the inner and outer walls of the extension defining said plurality of passages for conducting air and liquid, said plurality of passages being in communication at a front end of the inner wall of the extension with slots which extend at right angles to the inner wall of the extension and lead tangentially into a cavity of the mixture nozzle, said mixture nozzle comprising said first and second filling members, and the blind bore of said inner wall of the extension containing an air cushion provided behind the mixture nozzle for homogenization of spray delivery.

5. The device according to one of claim 1 to 4, wherein the insert and the cap include additional through holes for a further air path which conducts return air into the container when the cap is in the open position, wherein the additional through holes in the insert can be closed by a valve which is capable of allowing the passage of return air in only one direction.

6. The device according to claim 5, wherein a bead is provided on the inside of the container neck and a groove is provided on the outside of the insert, such that said bead and groove engage with each other to form a bead and groove connection having a limited locking action against axial movability of the insert and the container neck relative to each other.

7. The device according to claim 6, wherein said container is a reusable container, said cap is mounted around a periphery of the container neck and is provided on an inside surface with a boss which projects radially inward in a direction of the container neck such that after an axial movement of the cap in a direction toward the open position, the boss lies against an edge of the insert which projects radially outward beyond the container neck at an end of the insert, and upon further axial movement of the cap in said direction toward the open position permits the insert to be extracted from the container neck by overcoming the bead and groove connection.

8. The device according to claim 7, wherein said bead projects radially inwards a first radial distance such that said boss is able to extract said insert from the container by overcoming the bead and groove connection.

9. The device according to claim 8, wherein said first radial distance is about 0.2 millimeters.

10. The device according to claim 6 wherein said container is a non-reusable container, said cap is mounted around a periphery of the container neck and is provided on an inside surface with a boss which projects radially inward in a direction of the container neck such that after an axial movement of the cap in a direction toward the open position, the boss lies against an edge of the insert which projects radially outward beyond the container neck at an end of the insert, wherein siad bead projects radially inwards a second radial distance, and said boss being formed such that upon further axial movement of the cap in the opening direction said bead and groove connection is not overcome and said boss is destroyed.

11. The device according to claim 10, wherein the boss on the cap is tearable when the bead and groove connection is not overcome.

12. The device according to claim 10, wherein said second radial distance is about 0.4 millimeters.

* * * * *

UNITED STATES PATENT AND TRADEMARK OFFICE

CERTIFICATE OF CORRECTION

PATENT NO. : 5,275,338
DATED : January 4, 1994
INVENTOR(S) : Viktor Tobler

It is certified that error appears in the above-indentified patent and that said Letters Patent is hereby corrected as shown below:

On the title page, Item [30],

The Foreign Application Priority number should read:

--01214/91-5--

Signed and Sealed this

Tenth Day of May, 1994

*Attest:*

*Attesting Officer*

BRUCE LEHMAN

*Commissioner of Patents and Trademarks*